US010082295B2

(12) United States Patent
Zanetti et al.

(10) Patent No.: US 10,082,295 B2
(45) Date of Patent: Sep. 25, 2018

(54) GAS HEATING ARRANGEMENT AND METHOD FOR OPERATING A GAS HEATING ARRANGEMENT

(71) Applicant: Electrolux Appliances Aktiebolag, Stockholm (SE)

(72) Inventors: Filippo Zanetti, Forli (IT); Stefano Versari, Forlimpopoli (IT); Filippo Tisselli, Forli (IT)

(73) Assignee: Electrolux Appliances Aktibolag, Stockholm (SE)

( * ) Notice: Subject to any disclaimer, the term of this patent is extended or adjusted under 35 U.S.C. 154(b) by 159 days.

(21) Appl. No.: 15/102,187

(22) PCT Filed: Dec. 18, 2014

(86) PCT No.: PCT/EP2014/078364

§ 371 (c)(1),
(2) Date: Jun. 6, 2016

(87) PCT Pub. No.: WO2015/106919

PCT Pub. Date: Jul. 23, 2015

(65) Prior Publication Data

US 2016/0313008 A1 Oct. 27, 2016

(30) Foreign Application Priority Data

Jan. 16, 2014 (EP) ..... 14151356

(51) Int. Cl.
*F24C 15/10* (2006.01)
*F24C 3/08* (2006.01)

(52) U.S. Cl.
CPC ..... *F24C 3/082* (2013.01); *F24C 3/085* (2013.01); *F24C 15/107* (2013.01)

(58) Field of Classification Search
CPC ..... F24C 3/082; F24C 3/085; F24C 15/107
(Continued)

(56) References Cited

U.S. PATENT DOCUMENTS 2,542,265 A * 2/1951 Staples ..... A47J 37/046 126/299 R
6,017,211 A * 1/2000 Gort ..... F24C 3/085 126/39 E

FOREIGN PATENT DOCUMENTS

CN 101018982 A 8/2007
CN 201152567 Y 11/2008
(Continued)

OTHER PUBLICATIONS

Chinese Office action and Search Report issued in application No. PCT/EP2014/078364 dated Jun. 1, 2017; 17 pages (with translation).

(Continued)

*Primary Examiner* — Avinash Savani
(74) *Attorney, Agent, or Firm* — Pearne & Gordon LLP

(57) ABSTRACT

The gas heating arrangement (1000, . . . , 4000) according to the present invention improves the heat transfer of a Kitchen hob that has moveable gas burners (1180, 2140, 2160). Either a support structure (1180) is moved along with the gas burner or the support structure has a curved shape (3400) according to the movement trajectory (6500) of a gas burner, while at the same time leaving the space of the gas burner where the flames emanate free in order to allow optimum heat transfer at any location of the moveable gas burner. The method according to the invention provides a pin device and a hole at a turntable (5100, 6250) in order to apply movement to the turntable while not having to touch hot elements.

14 Claims, 6 Drawing Sheets

(58) Field of Classification Search
USPC ..... 431/266; 129/391, 39 E
See application file for complete search history.

(56) References Cited

FOREIGN PATENT DOCUMENTS

| | | | |
|---|---|---|---|
| CN | 203099937 | U | 7/2013 |
| EP | 2592355 | A1 | 5/2013 |
| JP | S5976912 | U | 5/1984 |
| JP | 2009006049 | A | 1/2009 |
| KR | 20100012627 | A | 2/2010 |
| KR | 20110112113 | A | 10/2011 |
| WO | WO2006006882 | A1 | 1/2006 |

OTHER PUBLICATIONS

International Search Report issued in PCT/EP2014/078364 dated Mar. 13, 2015, 2 pages.

* cited by examiner

GAS HEATING ARRANGEMENT AND METHOD FOR OPERATING A GAS HEATING ARRANGEMENT

When designing new kitchen appliances, such as kitchen hobs, developers and manufacturers strive to provide more flexibility and to facilitate the preparation of meals by optimizing and improving e.g. heaters, such as kitchen hobs, and in particular gas heaters. Recently, gas heaters with moveable gas burners have been introduced into the market to allow the user to combine gas burners to an individual heating zone that is comprised of e.g. two burners. The combination of two gas burners of a different size and heating capacity allows it to adapt a heating zone to the cooking requirement in terms of required heating power as well as the size of a cooking vessel, such as a pan.

On the other hand, however, moveable gas burners cause a problem regarding the support of cooking vessels and the impeding of the flame distribution underneath the cooking vessel. A support structure adapted to maintain a cooking vessel in combination with a moveable gas burner has a problem that it should not, while burning, heat the support structure, but predominantly the cooking vessel, such as a frying pan. Such a functionality is most desirable in terms of energy efficiency and in order to maximize heat transfer from a gas burner into a cooking vessel and thus into the food to be prepared.

The document KR 1020100012627 A discloses a kitchen hob that facilitates the adaptation of a cooking zone to cooking vessels of a different footprint.

No other related prior art is known.

The invention is based on the problem to improve the heat transfer to a cooking vessel in the presence of gas burners and an adaptable cooking zone.

This problem is solved by a gas heating arrangement according to claim 1 and a method for operating a gas heating arrangement according to claim 14.

Further developments of the invention are given in the dependent claims.

Advantageously, the gas heating arrangement according to the present invention takes a trajectory of movement of a gas burner into account and provides a corresponding support structure that minimizes the obstruction, while optimizing the distribution of the flames emitted by the moveable gas burner.

Advantageously, according to a further development of an embodiment of the gas heating arrangement according to the present invention, the support structure has substantially the shape of a trajectory of movement of a gas burner. In this manner, an optimum grating can be provided that along the movement path of a moveable gas burner minimizes obstacles for the flame distribution.

Beneficially, according to a further development of an embodiment of the arrangement according to the present invention, the support structure leaves the area of the movement of a gas burner free and thus facilitates an optimum energy transfer into the bottom of a cooking vessel. This, because it allows an optimum distribution of the gas flames underneath the cooking vessel.

Beneficially, according to a further development of an embodiment of the arrangement according to the present invention, the trajectory has the shape of an arc or curve. In this manner, a technically relatively simple design can be provided placing a moveable gas burner on a turntable and allowing considerable flexibility in combination of gas burners to form different cooking zones.

Favorably, according to a further development of an embodiment of the arrangement according to the present invention, the support structure comprises an oblong opening in approximately the width of a gas burner. In this manner, the shape of the support structure can be adapted as well to the trajectory of the movement of the gas burner and also to the extension of the movement of the gas burner in that the length of the slit corresponds to the extension of the movement of the gas burner.

Beneficially, according to a further development of an embodiment of the arrangement according to the present invention, the support structure comprises a moveable element. In this manner, once the moveable element and the moveable gas burner are aligned in a fixed positional relationship, an optimum flame distribution can be initially determined, and the support structure correspondingly adapted. As the burner and the support structure are moved together, the positional relationship never changes, and thus constant heat transfer independent of the position of the gas burner can be attained.

Beneficially, according to a further development of an embodiment of the arrangement according to the present invention, the moveable base is implemented in the form of a turntable. Rotational movements are used in a wide variety of technical applications, and thus reliable components are available on the market to guarantee the reliability of a kitchen appliance and a household product on the long term, while at the same time giving flexibility in its technical design.

Beneficially, according to a further development of a heat arrangement according to the present invention, a base is built into a baseplate. In this manner, in a kitchen environment, a continuous workplate can be presented that facilitates the preparation of food and provides more flexibility as it presents a greater area for the food preparation and the placement of pots or frying pans or sliced food and the like.

Advantageously, according to a further development of an embodiment of the heating arrangement according to the present invention, a sealing is provided between the baseplate and the base. In this manner, the security is improved, and the distribution of spilled fluid or hot oil can be reliably prevented.

Advantageously, according to a further development of an embodiment of an arrangement according to the present invention, the sealing is provided in the form of an annular ring. Such gaskets are available in many sizes, and their reliability is established as they have been used over many years in technological applications.

Favorably, the turntable according to a further development of an arrangement according to the present invention comprises a peripheral hole that can be engaged to apply rotational movement to the turntable.

Beneficially, according to a further development of an embodiment of the heating arrangement according to the present invention, a pin device is provided that can engage the hole in the turntable in order to apply rotational movement to adjust different configurations of cooking zones. This has the advantage that no hot parts need to be touched and that the rotational movement can be applied precisely without risk of burns.

Advantageously, the method for operating a gas heating arrangement according to the present invention provides a pin device, favorably a knob that engages a turntable carrying a moveable gas burner to apply rotational movement to the turntable and thus the gas burner. Such a method can easily be applied in kitchen environments, as it allows a safe and reliable adjustment of a variable cooking zone.

Beneficially, according to a further development of the method according to the present invention, the pin device is supported in a separate hole in the workplate and thus is readily available for adjustments of cooking zones and cannot be misplaced.

Subsequently, the invention will further be explained on the basis of embodiments shown in drawings, wherein FIG. 1 shows an embodiment with a moveable support structure;

Figure 1:
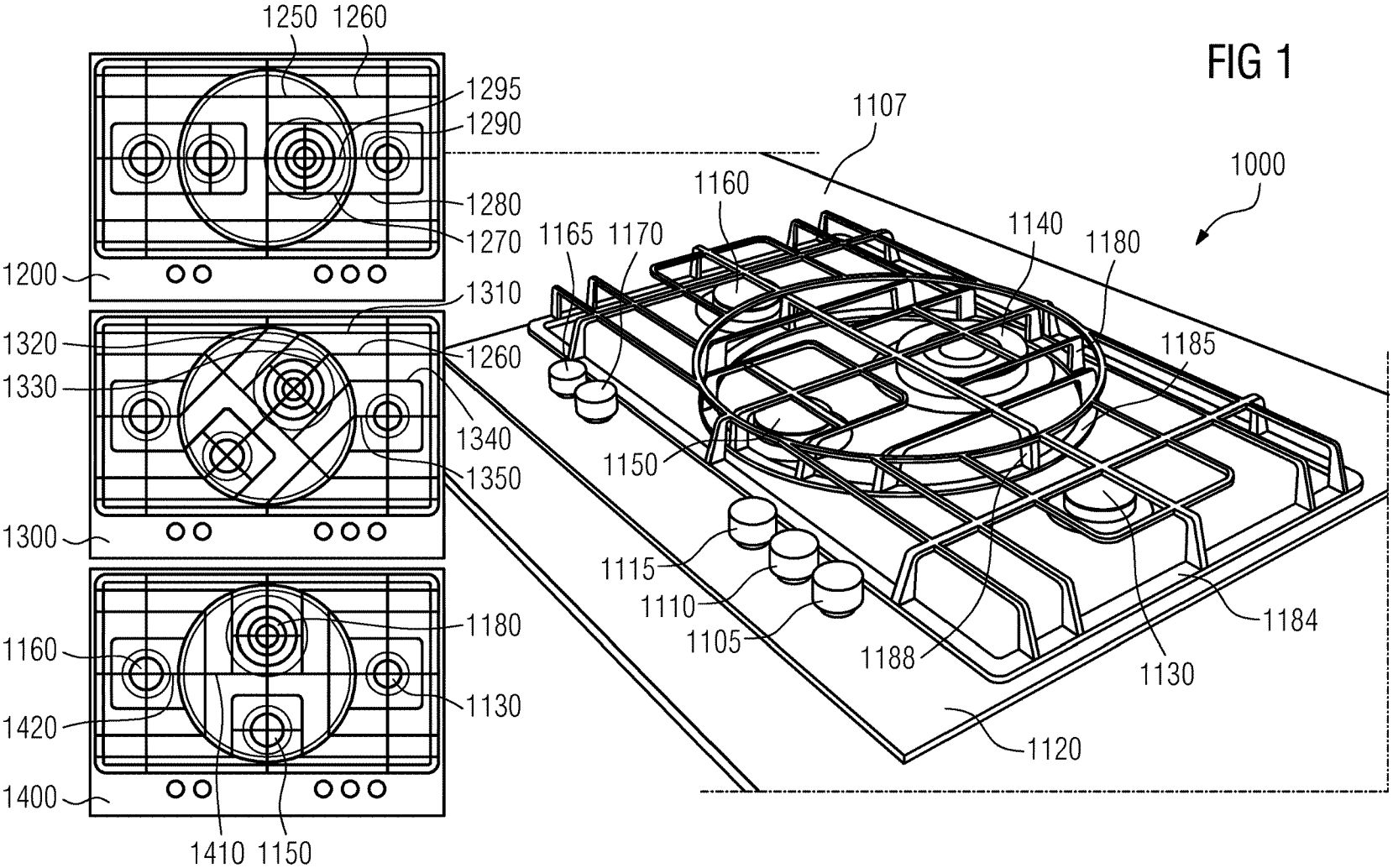

Generally, FIG. 1 shows a gas heating arrangement 1000. It comprises a fixed support structure for cooking vessels, such as pans or large cooking pots or broad-shaped cooking vessels 1184, and it also comprises a moveable part 1180. The moveable part consists of a support structure 1188 fixed to the turntable by means of a base 1185. The turntable comprises two gas burners 1140 and 1150 of which the gas burner 1140 is larger and thus has a larger heating capacity. Further, two gas burners 1130 and 1160 are indicated which are fixed on a baseplate 1120 that also comprises adjustment knobs 1105, 1110, 1115, 1165 and 1170. The baseplate can be built onto a larger workplate 1107 to present a seamless larger cooking and working area. The moveable support structure 1180 is designed in such a manner that it allows an optimum flame distribution of the gas burners 1150 and 1140, irrespective of the location of the gas burners. By rotational movement, one of the gas burners 1140 and 1150 can be positioned closely respectively to one of the gas burners 1130 or 1160. The moveable support structure 1180 follows a trajectory of movement of the turntable as it is fixed to the turntable with its base 1185 and turns with it in a rotational movement.

Further, FIG. 1 shows various configurations 1200, 1300 and 1400 of gas burners to e.g. form cooking zones. In the example 1200, all the gas burners are in line, and elements of the grating 1250, 1260; 1290, 1295; and 1270 and 1280 all form a continuous line to give a neat optical impression of the kitchen hob in this configuration.

At configuration 1300, the gas burners are aligned diagonally. In this configuration, still parts of the grating 1320 and 1310 as well as 1340 and 1260 form a continuous line and thus, in this configuration, also provide a continuous support structure. As depicted in configuration 1400, the part of the grating 1410 forms a continuous line between the burners 1130 and 1160 and a subpart of the grating 1420.

Figure 2:
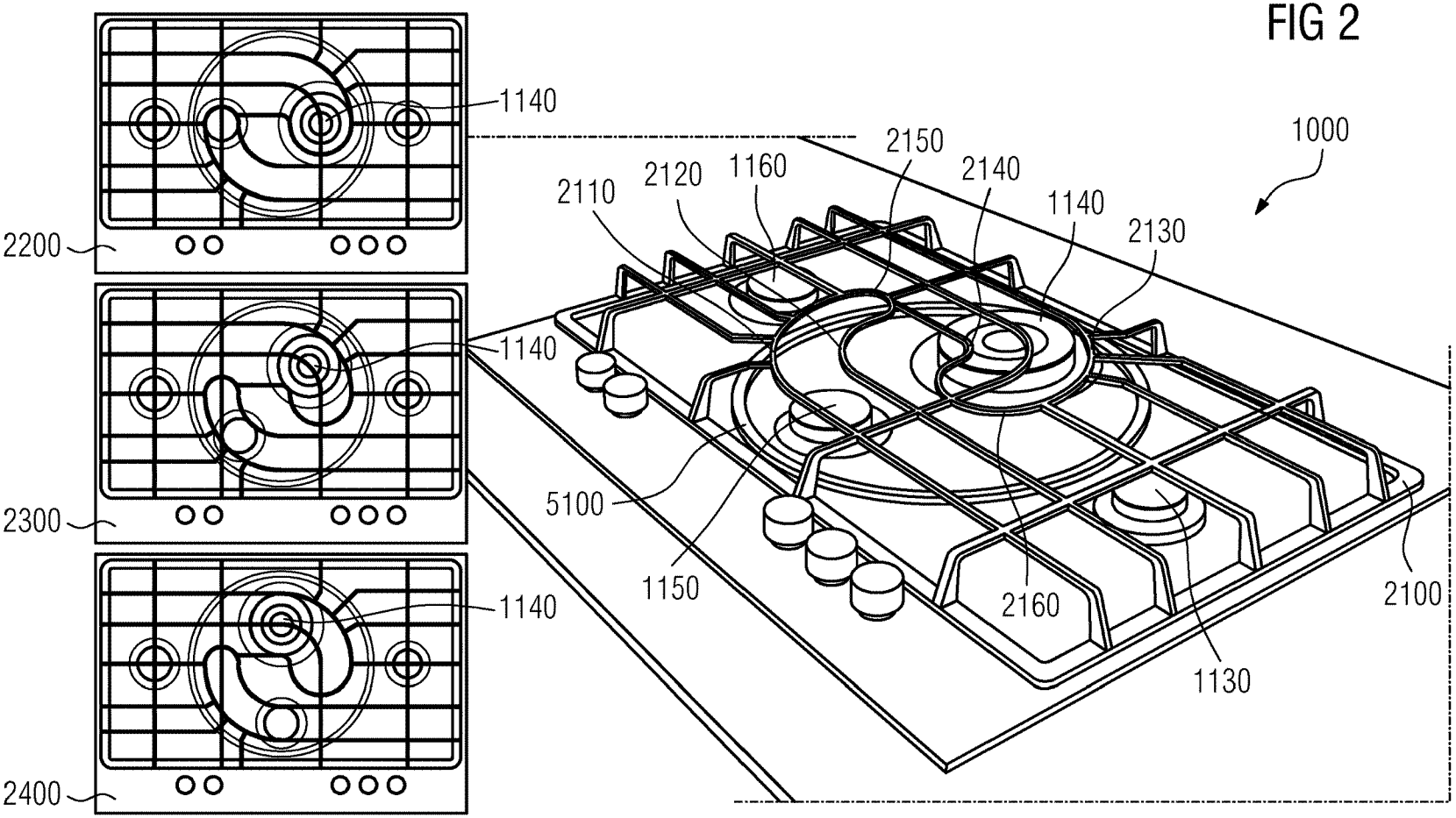
FIG. 2 shows an embodiment with a fixed support structure.

In FIG. 2 a different embodiment is shown, wherein the support structure follows the trajectory of movement of the gas burners. Here, and throughout all the figures components having the same function are denominated by the same reference signs in order to facilitate the understanding.

The support structure 2100 comprises no moving parts. Solely, there is the turntable 5100 which allows a rotational movement of the gas burners 1140 and 1150. There are support elements 2130, 2140 and 2160 that are adapted to follow the trajectory of the gas burner 1140 when it is rotated on the turntable 1185. Opposing them, there are also elements of the support structure 2110, 2150 and 2120 that are adapted to follow the movement of the gas burner 1140, once it moves on a trajectory following the movement of the turntable. The adapted structure elements of the support structure have a curved shape and they are spaced apart to allow an optimum flame distribution of respectively the gas burner 1140 and 1150.

At configuration 2200, all the gas burners are aligned on a horizontal axis. Here, they form two larger cooking zones with a large gas burner 1140 on the right side. It can also be seen that the burners have reached an end position in an oblong opening of the support structure.

At configuration 2300, the gas burners 1140 and 1150 are arranged diagonally and flames emanated by the gas burners can pass uninhibited throughout the support structure to heat a cooking vessel.

At configuration 2400, the gas burners 1140 and 1150 are positioned in a different configuration reminding of a cross shape with the large gas burner 1140 on top. In this case, another extreme position is taken in by the gas burners that is also accommodated by the support structure and fully allows a flame distribution from flames emanated from the gas burners 1140 and 1150 and thus provides an optimum heating efficiency.

Figure 3:
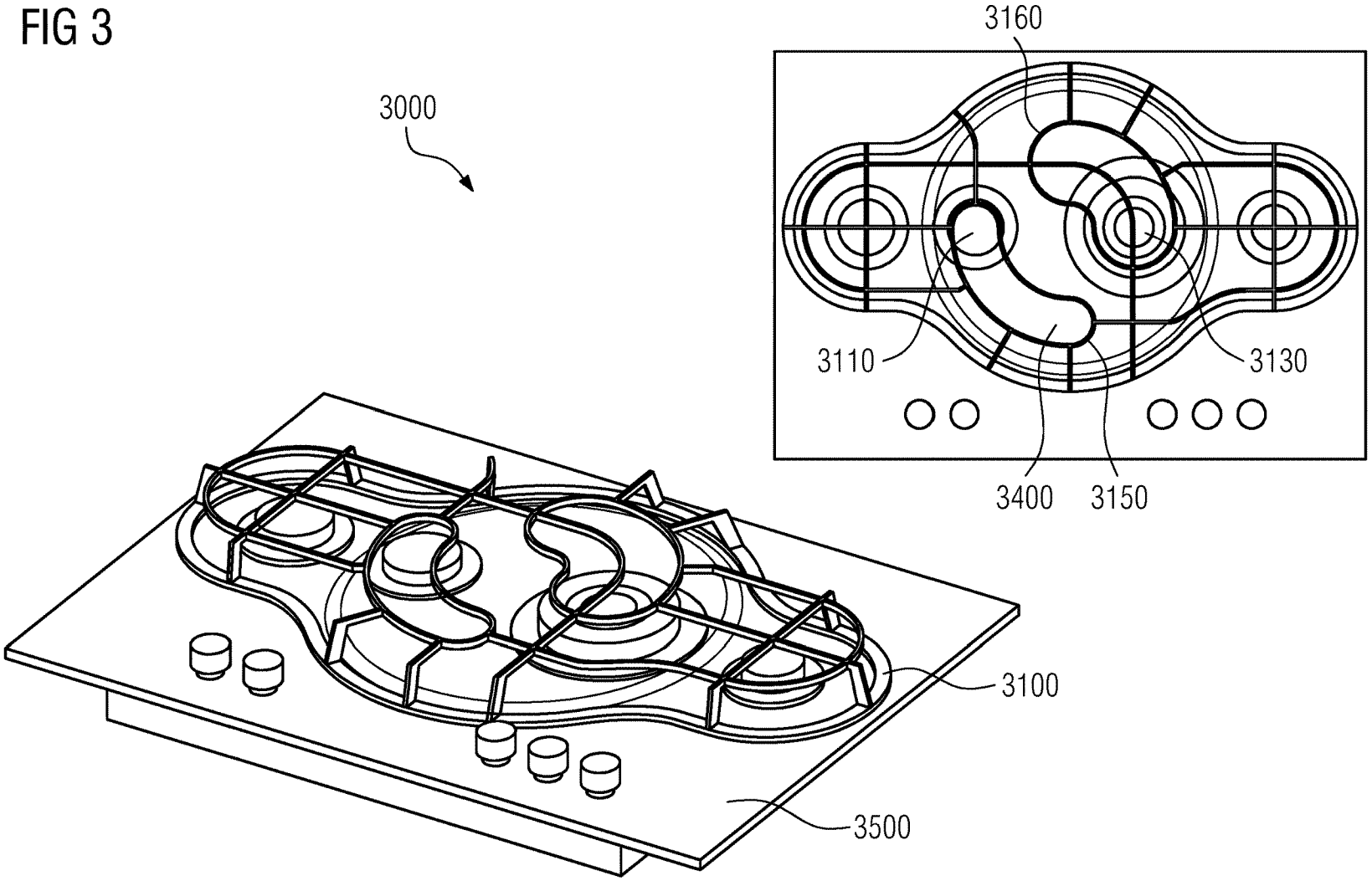
FIG. 3 shows an embodiment with a fixed support structure in an elongated shape.

FIG. 3 shows another example of a heating arrangement with a fixed support structure. Apart from the circumference that is different, it can also be recognized that the elongated slits in comparison to the ones shown in FIG. 2 are extending in a mirror image of the previous ones from FIG. 2. Depending on the rotational movement of the gas burners 1140 and 1150 the shape of the support structure may be adapted accordingly. A curved end 3150 of slit 3400 is close to the operating elements, detailed in FIG. 1 and is completed at complementary corresponding curved shape 3160. Further, it can be seen that the slit that is provided for the larger burner has a greater width.

Figure 4:
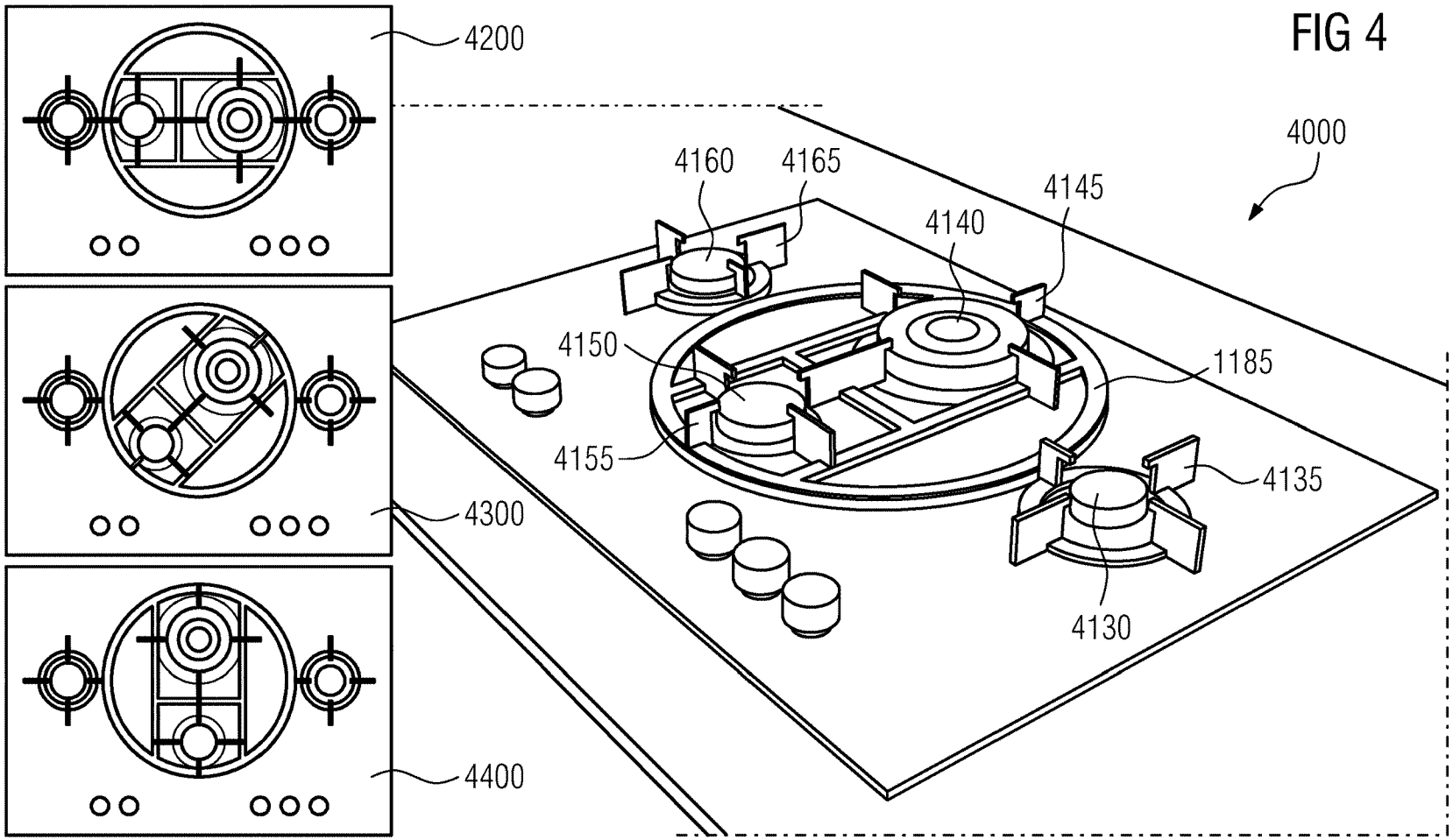
FIG. 4 shows an embodiment minimizing the support structure.

As FIG. 4 shows, the support structure of a gas heating arrangement 4000 can be reduced to a minimum configuration in which one integrates two gas burners 4140 and 4150 with support structures 4145 and 4155. More gas burners 4130 and 4160 are completed respectively by support structures 4165 and 4135. As previously shown in FIG. 1 for instance, at configuration 4200, all burners are aligned to perform a straight line. At configuration 4300, the middle burners 4140 and 4150 on the turntable are aligned diagonally between the two framing burners 4130 and 4160, and at configuration 4400, they are aligned to form a configuration that resembles a cross shape.

Figure 5:
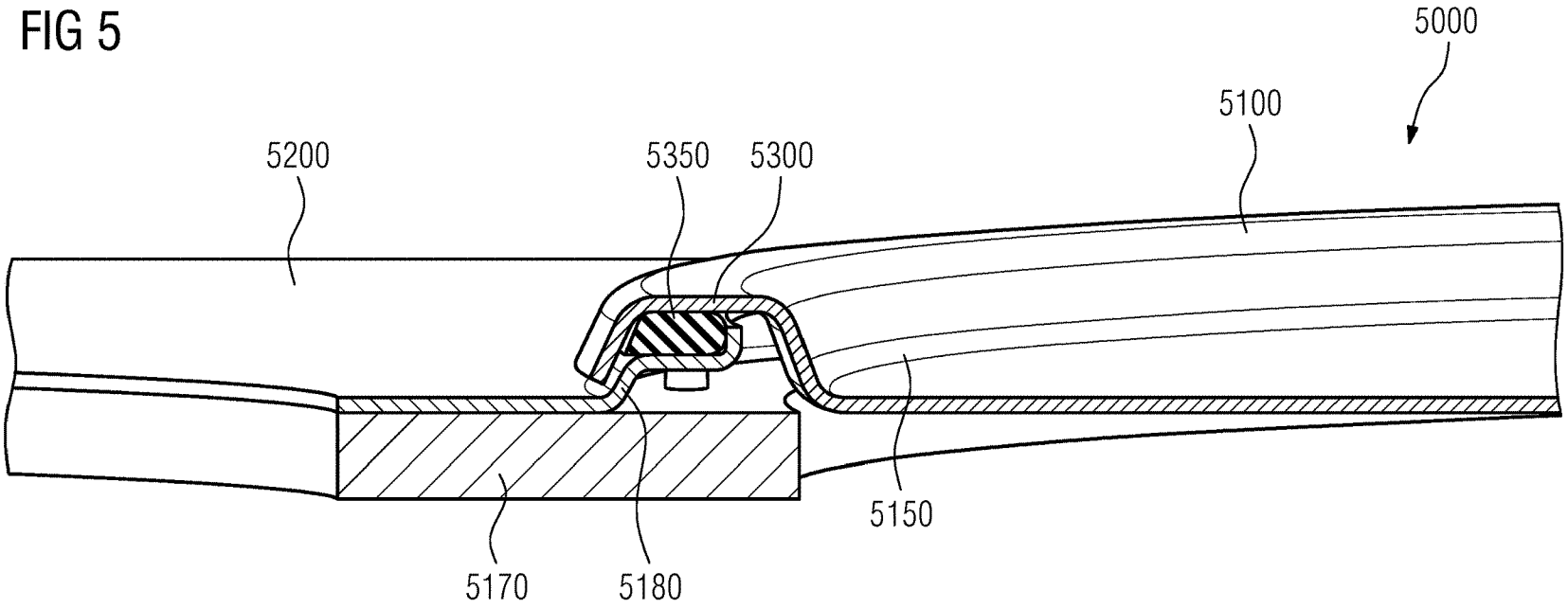
FIG. 5 shows an example of a gasket underneath a turntable.

As FIG. 5 shows, a base for a gas heating arrangement 5000 can be in the shape of a turntable 5100. Further, it may have a sealing 5350, and the turntable may have a height extension of 5150, favorably of 5 mm. It can also be seen that the baseplate 5200 is adapted to a profile to accommodate the sealing 5350 which is beneficially in the shape of an annular ring or annular sectors. In this manner, the penetration of spilled cooking fluids below throughout the baseplate can be reliably prevented.

Figure 6:
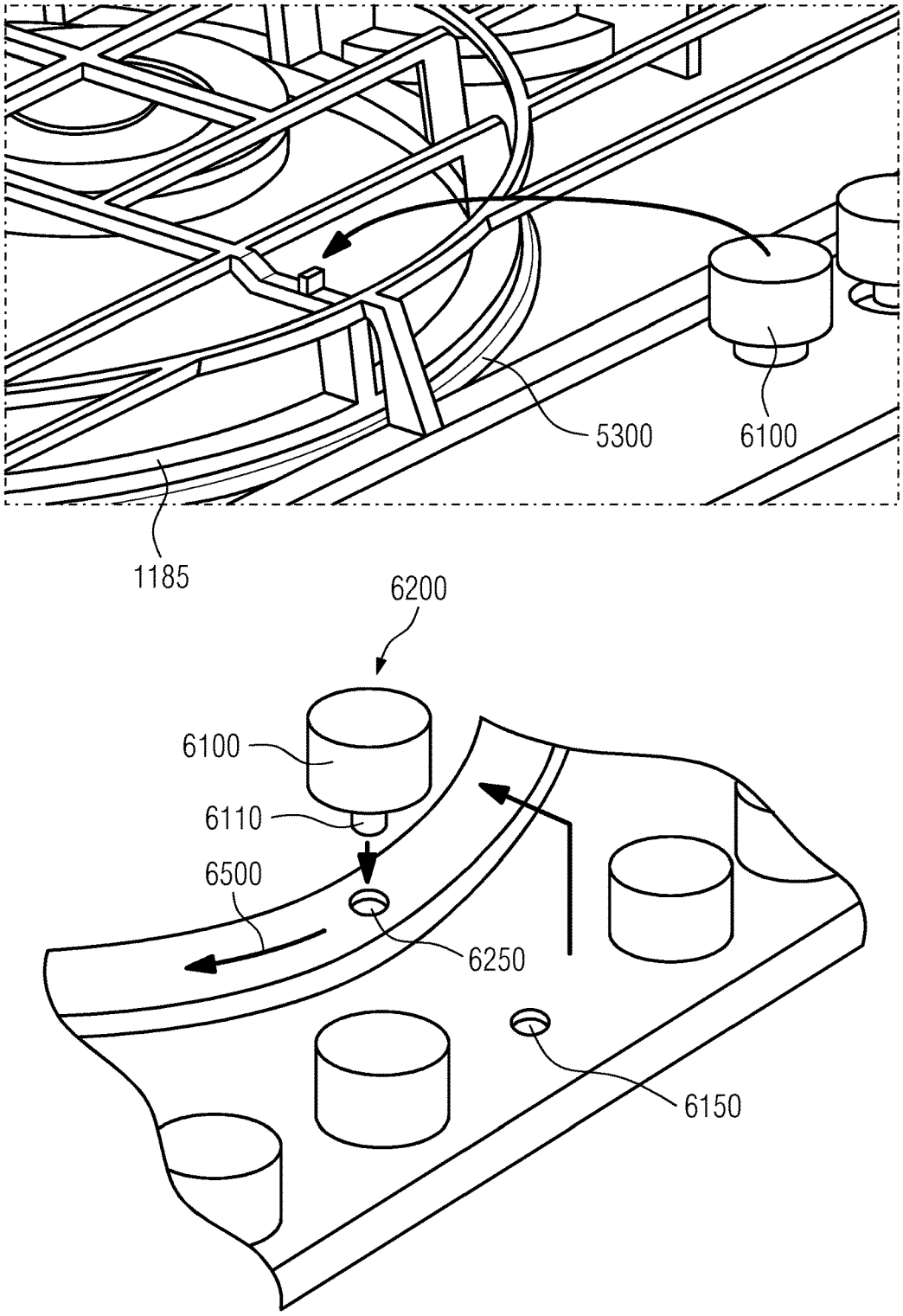
FIG. 6 shows an example of a pin device to operate a turntable.

FIG. 6 gives an example of a detailed view of an embodiment of a support structure and a turntable according to the present invention.

Here, a moveable support structure 1185 is shown, it is placed on a turntable 5300. An annular part of the support structure 1185 e.g. favorably acts as a shield for the sealing against flames or the heat of the flames. Further, an operating knob 6100 is depicted which underneath contains a pin 6110. The turntable 5300 may comprise a hole 6250 where the knob 6100 with the pin 6110 underneath can be inserted in order to apply a rotational movement to the turntable 5300. For storage purposes, and when not needed, the pin device/ knob 6100 can be stored in a separate hole 6150 provided in the baseplate. In this manner, rotational movement can be applied to a turntable in order to adjust configurations of moveable gas burners without having to touch hot parts and facilitating the operation of the gas heating arrangement.

LIST OF REFERENCE NUMERALS

1000, 2000, 3000, 4000, 5000 embodiments;
1130, 1140, 1150, 1160, 4130, 4140, 4150, 4160 gas burners;
1105, 1110, 1115, 1170, 1165 operating knobs;
1107 Workplate
1180 moveable support structure;
1185 base of moveable support structure;
1188 distance element of moveable support structure;
5300 turntable
1200, 1300, 1400 heating configurations
1250, 1260, 1290, 1295, 1280, 1270 structural elements of support structure;
1320, 1350, 1310, 1340 structural elements of support structure;
1420, 1440 structural elements of support structure;
2100: fixed support structure
2130, 2140, 2120, 2110, 2150 curved elements of support structure;
2200, 2300, 2400 configurations of moveable gas burners;
3500 baseplate
3100 oblong-shaped support structure;
3150, 3160 curved support structures
3110, 3130 gas burners
3400 opening;
4165, 4135, 4145, 4155 elements of minimum support structure;
4200, 4300, 4400 different configurations of gas burners with minimum support structure;
5100 turntable
5300 border of turntable
5150 depth of turntable
5350 sealing;
5180 support for sealing
5200 baseplate;
5170 glass plate
6100 operating knob
6110 pin;
6200 example
6250 engagement hole in turntable for a pin device;
6150 hole
6500 movement trajectory

The invention claimed is:

1. A gas heating arrangement, comprising:
a moveable gas burner,
a support structure to support a cooking vessel over the moveable gas burner, wherein the support structure is adapted to follow a shape of a trajectory of movement of two moveable gas burners, wherein the support structure comprises a moveable element.

2. The gas heating arrangement according to claim 1, wherein the support structure has substantially the shape of the movement trajectory.

3. The gas heating arrangement according to claim 2, wherein the support structure leaves an area corresponding to the size of the moveable gas burner free.

4. The gas heating arrangement according to claim 1, wherein the movement trajectory has an arc shape.

5. The gas heating arrangement according to claim 1, wherein the support structure comprises an oblong opening.

6. The gas heating arrangement according to claim 1, wherein the moveable element and the moveable gas burner comprise a common moveable base.

7. The gas heating arrangement according to claim 6, wherein the base is a turntable.

8. The gas heating arrangement according to claim 6, wherein the base is supported on a baseplate.

9. The gas heating arrangement according to claim 7, wherein the baseplate and the turntable form a support for a sealing.

10. The gas heating arrangement according to claim 9, wherein the sealing is an annular ring or is formed by annular sectors.

11. The gas heating arrangement according to claim 7 wherein the turntable comprises a hole.

12. The gas heating arrangement according to claim 11, further comprising a pin device.

13. A method for operating a gas heating arrangement according to claim 12, wherein the pin device engages the hole in the turntable for moving the gas burner along a movement trajectory.

14. The method for operating a gas heating arrangement according to claim 13, wherein the pin device is supported in a hole on the baseplate.

* * * * *